US005533564A

United States Patent [19]

Alberola et al.

[11] Patent Number: 5,533,564

[45] Date of Patent: Jul. 9, 1996

[54] DIE CASTING FOUNDRY MACHINE ADAPTED IN PARTICULAR TO THE PRODUCTION OF METAL PARTS IN SMALL AND MEDIUM SERIES

[75] Inventors: Marcel P. G. Alberola, Aulnay sous Bois; René G. M. Marchal de Corny, Paris; Georges M. Alexandre, Menestreau en Villette, all of France

[73] Assignee: Alu Livry, Livry Gargan, France

[21] Appl. No.: 352,861

[22] Filed: Dec. 2, 1994

[30] Foreign Application Priority Data

Dec. 3, 1993 [FR] France ..... 93 14550

[51] Int. Cl.[6] ..... B22D 17/26; B22D 33/04

[52] U.S. Cl. ..... 164/342; 164/334; 164/340; 164/341; 164/137

[58] Field of Search ..... 164/342, 341, 164/340, 339, 137

[56] References Cited

FOREIGN PATENT DOCUMENTS 923693 8/1955 Germany .

1228003 4/1971 United Kingdom .

*Primary Examiner*—Jack W. Lavinder
*Assistant Examiner*—I.-H. Lin
*Attorney, Agent, or Firm*—Pennie & Edmonds

[57] ABSTRACT

A foundry die casting machine for the small and medium-scale production of metal parts, having at least two die cheek parts for receiving molten materials, wherein the die cheek parts form a cavity, a framework having a supporting wall for supporting the die cheek parts, at least one cheek-moving jack having means for supporting and displacing the die cheek parts, which permits removal of the metal parts, at least one removable coupling member, wherein an end of the coupling member is removable and directly supported by a die cheek part and the other end is removably connected to the cheek-moving jack, at least one cheek-moving jack carrier mounted on said framework, at least one hollow-formation reservation member for insertion into the cavity, at least one reservation member-moving jack having means for supporting and displacing the hollow-formation reservation member, and at least one removable reservation member-moving jack carrier, wherein an end of the latter is removably and directly supported by one of the die cheek parts, the invention being applicable to the manufacture of parts of aluminum alloy.

14 Claims, 5 Drawing Sheets

DIE CASTING FOUNDRY MACHINE ADAPTED IN PARTICULAR TO THE PRODUCTION OF METAL PARTS IN SMALL AND MEDIUM SERIES

The present invention to a die casting foundry machine adapted in particular to the production in small or medium series of metal parts made for example from aluminum or light alloy in particular by the technical process of gravity die casting of molten metal.

BACKGROUND OF THE INVENTION

A type of die casting machine generally used consists of a framework supporting a bed plate forming a die base or bottom, at least two platens displaceable on the said bed plate under the action of main jacks and a plurality of cavity reservation members such as pins or cores movable under the action of secondary jacks.

A mold or die consisting generally of two half molds or die cheeks is fastened through the medium of the said cheeks onto the confronting faces of the said platens. The cheeks are adapted to be assembled so as to form a fluid-tight die sealed against molten metal and withstanding the thrust exerted by the latter.

The die casting devices currently used for the production in small and medium series are generally actuated by hand or in the best of the cases partially mechanized by means of mechanical jacks or toothed racks allowing a limited number of movements, for example 2 or 3 motions thereby permitting to reduce the manufacturing costs of the die casting machines.

However the die casting contrivances intended for the production in small and medium series suffer from many inconveniences among which may in particular be cited the following inconveniences:

- it is necessary to fit the foundries with a great number of die casting machines adapted to the various mold kinds used owing to the large diversity of the molds used in the production of small and medium series,
- the component elements of the die casting machines, namely the framework and the aforesaid mechanical actuating mechanisms are generally brought to to a standstill finally owing to the fact that their dismantling would require a long and hard manual work and that some elements may not be reused such as the jack holders which are manufactured with a specific length adapted to a given mold,
- the cost of each die casting machine may not be made profitable owing to the fact that most of the molds are used once or six times a year only and each time for a duration generally lying between one half-day and a week,
- each die casting machine is often kept for a very long duration sometimes greater than ten years thereby generating a huge need for storage owing to the substantial bulk of each framework and to the impossibility of storing the latter in height and very high costs of maintenance and of supply of spare parts,
- some movements are not automatized or mechanized in particular when it is necessary to insert pins or cores in directions inclined with respect to the vertical or horizontal direction, these operations being then carried out manually.

In the production in large series are known improved automatized die casting machines comprising a hydraulic distribution group allowing to provide for a great number of movements, for example from six to eight movements.

These die casting machines are designed with a basic equipment allowing to actuate a large number of jacks through the medium of an automaton connected to a central processing unit which is in charge of the production monitoring or management of the corresponding die casting machine.

However these automatized die casting machines may not be used in a profitable mariner in the production in small and medium series for the following grounds:

- the hydraulic distribution group is often very clearly under-employed owing to the fact that the production of many foundry parts generally requires the motion of one or two pin-operating or core-operating jacks only in addition to the cheek-operating jacks,
- this under-employment does not permit to redeem the very high expense of the automatized die casting machines in the case of a production in small and medium series,
- the duration of adjustment of a given mold on these die casting machines is very long with respect to the production time in small and medium series thereby making their use incompatible with frequent changes of molds which are peculiar to or inherent in the production in small and medium series,
- the diversity of shapes of the molds and of positions of the pins or cores in the production in small and medium series is such that the use of one single automatized die casting machine may not be contemplated to meet all the needs.

The object of the present invention is therefore to propose a die casting machine allowing to avoid the aforesaid drawbacks, which should be adaptable to the various kinds of molds used in the production in small and medium series, which exhibits low mounting time and costs and which should be automatizable.

SUMMARY OF INVENTION

The subject of the present invention is a die casting machine intended in particular to the production of metal parts in small and medium series, comprising a die supporting framework, a bed plate possibly forming the die base or bottom, at least two die cheek members displaceable through the medium of couplings under the action of cheek-moving jacks, cheek-moving jack carriers mounted onto the said framework and carries for the jack operating reservation members such as pins or cores, characterized in that the couplings of the cheek-moving jacks are directly supported removably by the said cheeks and that at least one of the said carriers of reservation member actuating jacks is directly supported removably by the said cheeks and/or the bed plate.

The die casting machine of the invention does not comprise any movable platens for supporting the cheeks unlike the known die casting machines, thereby permitting to simplify the structure of the die casting machine.

Moreover unlike the conventional die casting machines some reservation member actuating jack carriers of the die casting machine according to the invention are not mounted onto the framework but are directly mounted removably onto the cheeks and/or the bed plate of the die casting machine.

According to a particularly advantageous characterizing feature of the die casting machine according to the invention, the free ends of the couplings of the cheek-moving jacks and of the reservation member actuating jack carriers are adapted to be removably fastened onto hooking members such as preferably removable studs which are projecting from the external surface of the die casting machine.

The hooking members may for instance be provided in the shape of cylindrical studs or bolts provided wish a throat portion with a reduced cross-section or as dovetail-shaped tenons or studs adapted to be fitted in a mortise or slot of corresponding or mated shape formed in the aforesaid free ends thereby permitting quick installation and removal of the couplings and of the jack carriers onto and from the cheeks.

According to another particularly advantageous characterizing feature of the invention, the die casting machine comprises a removable strut connecting the rod of each jack to its corresponding movable member, namely a cheek-moving jack coupling or a reservation member support, each strut comprising a projecting portion adapted to be in abutment against the cheek-moving jack carriers or reservation member actuating jack carriers for limiting the useful stroke of each jack, each strut being interchangeable and belonging to a range of modules of predetermined lengths so as to adjust the said useful stroke of each jack.

The aforesaid modular struts allow to adapt any same jack to the different types of molds used.

The cheek-moving jack carriers may advantageously be mounted onto the framework of the die casting machine so as to be removable and adjustable for example by an indexing system.

The cheek-moving jack carriers therefore also pertain to a range of modules of predetermined shapes permitting in particular to mount cheek-moving jack carriers with several stages of jacks working in parallel relationship onto the framework of the die casting machine in the case of the use of a die with a great height.

A hole is advantageously formed through the bed plate carrying wall of the framework of the die casting machine to permit the passage of a lower reservation member plumb with the place adapted to receive the bed plate, the said hole being adapted to receive reducing frames of a nest of frames which may be fitted into each other and belonging to a range of modules of predetermined sizes thereby permitting to adjust the dimensions of the said hole without modifying the dimensions of the bed plate of the die casting machine.

This latter characterizing feature is particularly advantageous since it allows to restrict the number of bed plates to be manufactured, which are very expensive.

Each coupling may advantageously be superimposed to at least one reservation member moving jack carrier.

According to another particularly advantageous characterizing feature of the invention, the top face of the bed plate carrier of the framework is provided with an indexing device adapted to co-operate with snugs or lugs which are projecting underneath and from the bed plate so as to position the latter onto the framework.

The aforesaid indexing device may consist of a plurality of holes and of an elongated groove or slot arranged on either side of the aforesaid thoroughfare hole and adapted to receive one of the said snugs or lugs which are projecting underneath and from the bed plate.

The bed plate is advantageously held against motion in the height direction on the framework through the medium of stops displaceable in guide grooves formed in the bed plate carrying wall of the framework and adapted to engage the said bed plate sidewise.

In the case where the mold exhibits a reduced top face, the upper reservation member moving jack carrier may consist of a gantry adapted to be removably mounted onto the said framework.

The modular die casting machine according to the invention allows to dispense with any adjustment, each mold corresponding to a predetermined set of modules of struts and of jack carriers. The mounting time of the different modular elements of the die casting machine according to the invention is very clearly lower than the adjustment time of the known automatized die casting machines. The mounting time may be below 10 minutes thereby making the die casting machine according to the invention particularly suited to the production of metal parts in small and medium series without requiring a particularly qualified labour.

The die casting machine according to the invention may advantageously be controlled alone or collectively together with other die casting machines according to the invention by a programmable automaton through the medium of a central processing unit thereby permitting to automatize the die casting machines in the small and medium-scale production.

It is also possible to control several die casting machines according to the invention through the agency of one single automaton and to program the latter for selectively operating the currently available jacks mounted onto each die casting machine whereas in the known automatized die casting machines, each die casting machine is controlled by one automaton which is peculiar thereto.

BRIEF DESCRIPTION OF THE DRAWINGS

The invention will be better understood and further objects, characterizing features, details and advantages thereof will appear more clearly as the following explanatory description proceeds with reference to the accompanying diagrammatic drawings given by way of non-limiting examples only illustrating several presently preferred specific embodiments and in which.

DESCRIPTION OF THE PREFERRED EMBODIMENTS

Figure 1:
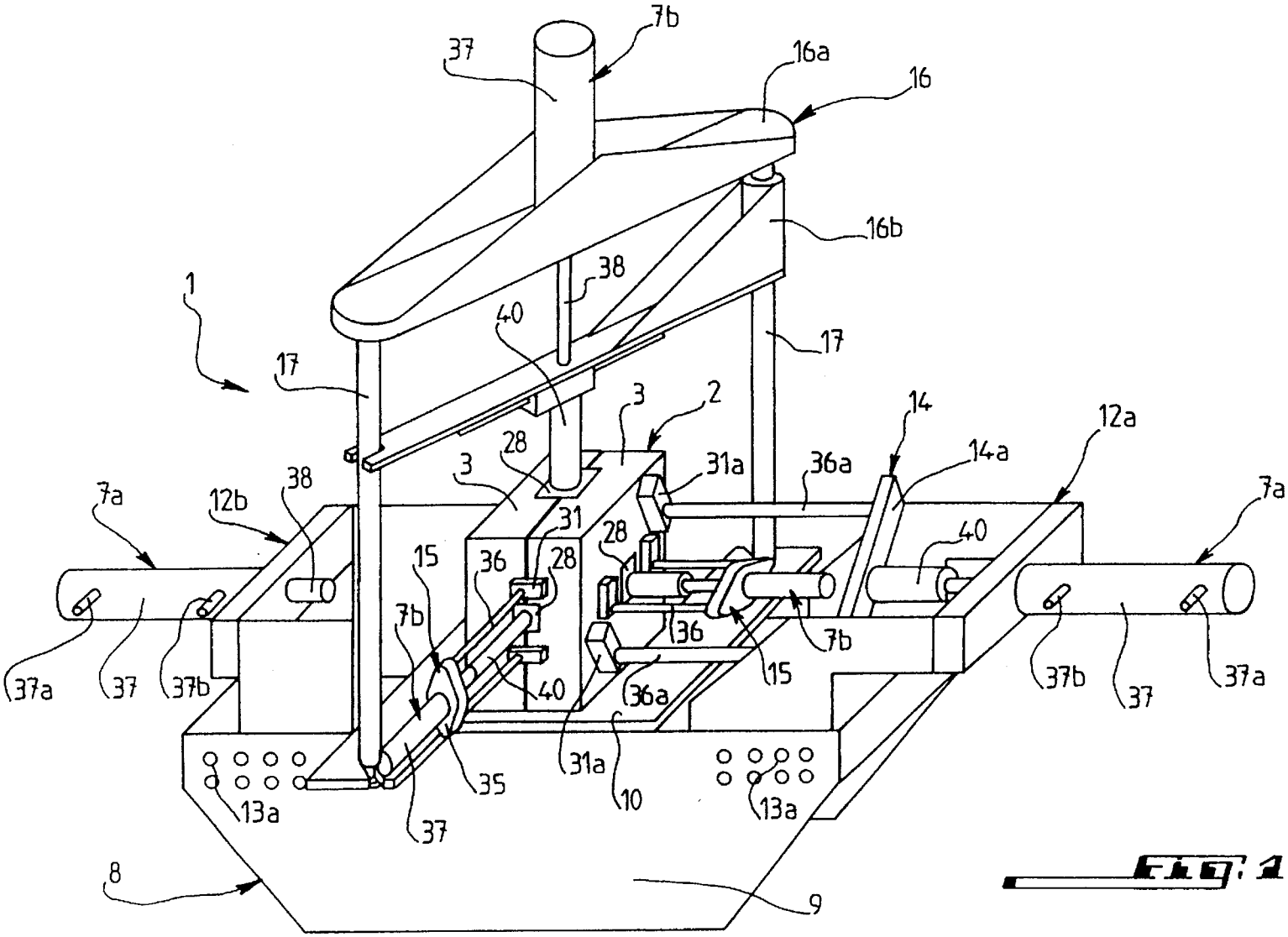
FIG. 1 is a diagrammatic perspective view of a first embodiment of the die casting machine according to the invention.

FIG. 1 shows a first particular embodiment of an automatized modular die casting machine 1 of the invention.

The die casting machine 1 of the invention is intended in particular for the small and medium-scale manufacture of metal parts (not shown on the drawings) by the molten metal gravity casting process.

The molten metal is poured into the inside of a die or mold 2 through the medium of a casting ladle or spoon (not shown on the drawings) either manually or mechanically.

Within the meaning of the present invention, the small, medium and large-scale productions correspond to the manufacture of some tens, some hundreds and at least some thousands of metal parts.

The die 2 generally consists of two cheeks 3 adapted to be assembled together so as to form a fluid-tight die 2 sealed against molten metal and withstanding the thrust exerted by the latter.

Figure 5:
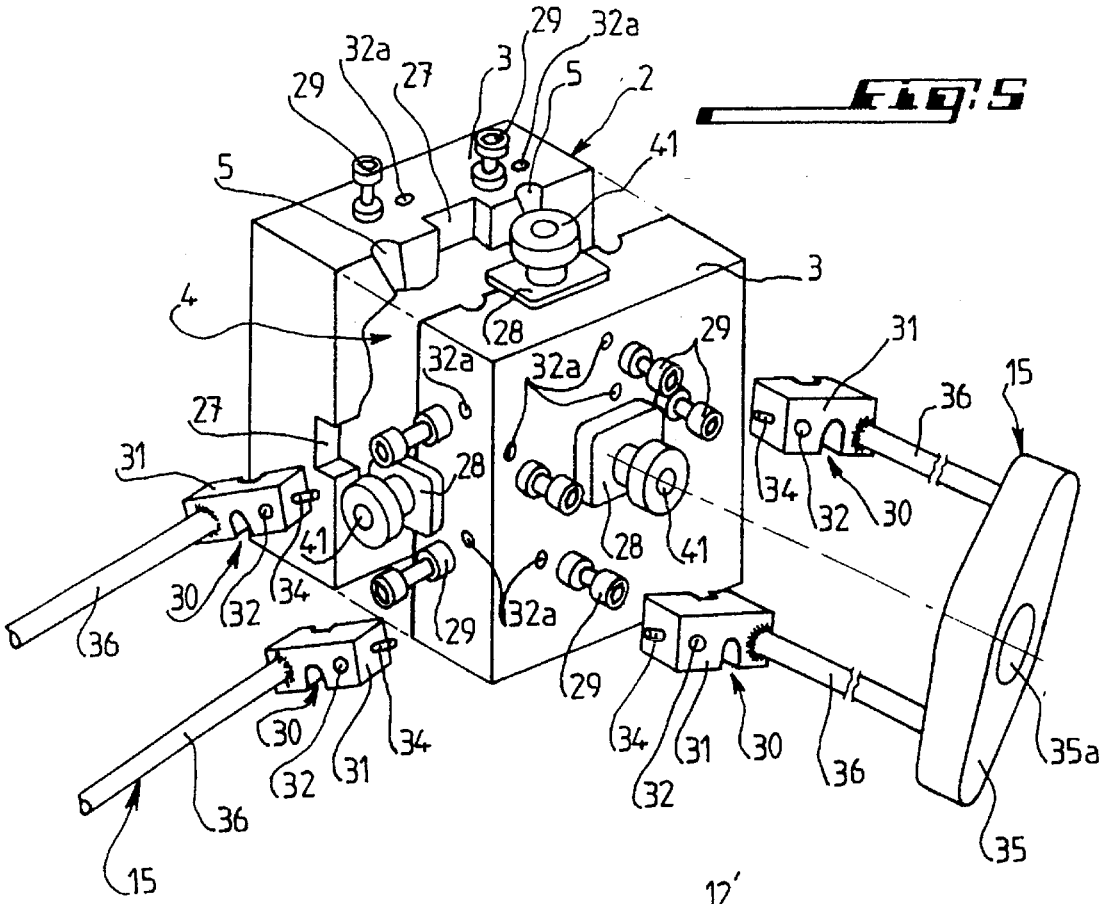
FIG. 5 is a partially exploded perspective view of the die casting machine in a non-assembled position according to a second embodiment of the die casting machine of the invention.

It is seen on FIG. 5 that recesses 4 are formed in each one of the confronting faces of the cheeks 3. The recesses 4 form the mold cavity and are intended to provide the external shapes to the metal part to be produced.

Both apertures 5 formed through the top wall of the cheeks 3 are opening into the recesses 4.

When both cheeks 3 are in the assembled position, the recesses 4 form an internal accommodation means intended to be filled with a molten metal such as a liquid aluminum alloy through the agency of the apertures 5.

The number of apertures 5 is advantageously lying between 1 and 4.

Figure 2:
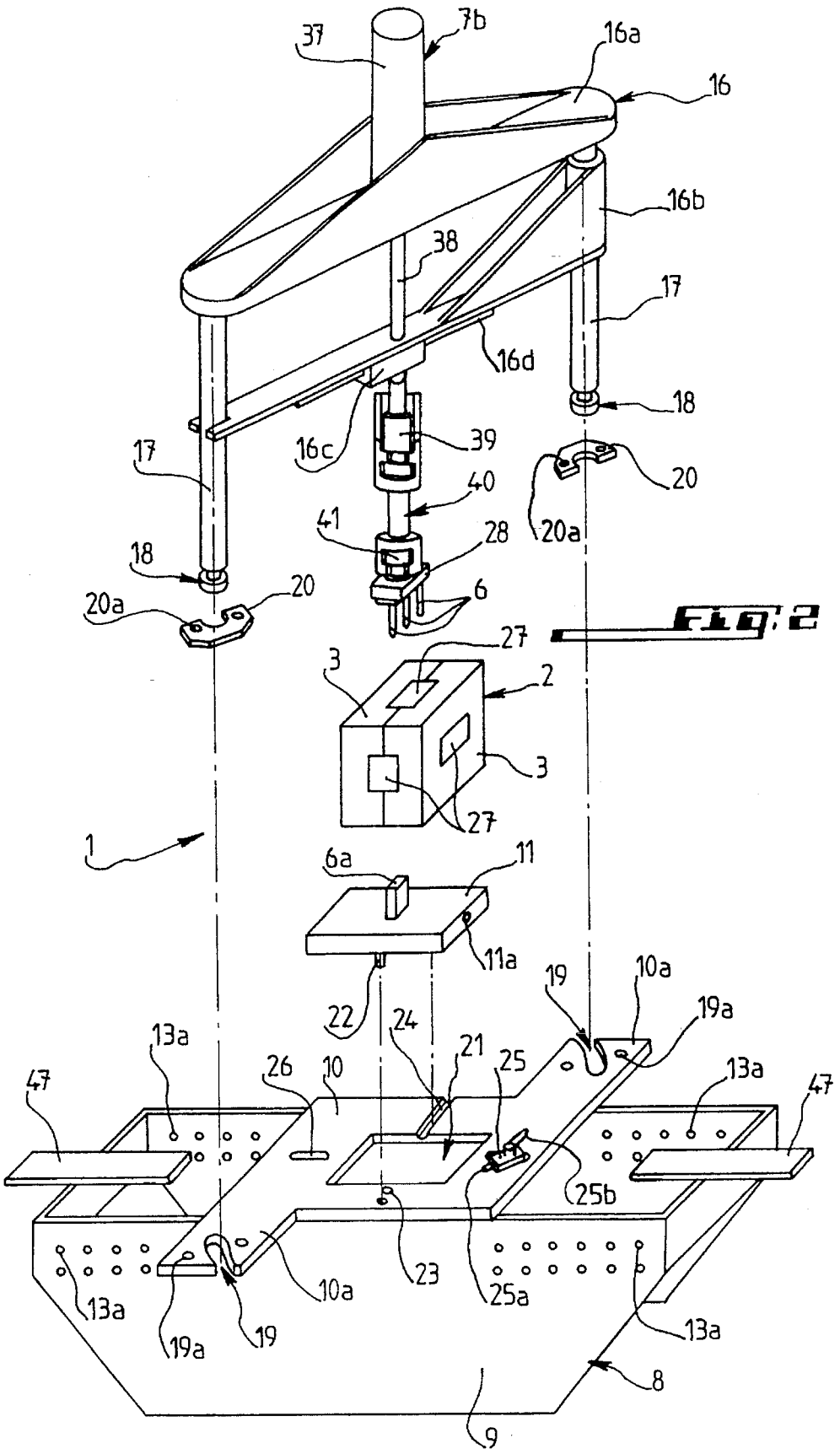
FIG. 2 is a partial exploded perspective view of the die casting machine shown on FIG. 1.
Figure 4:
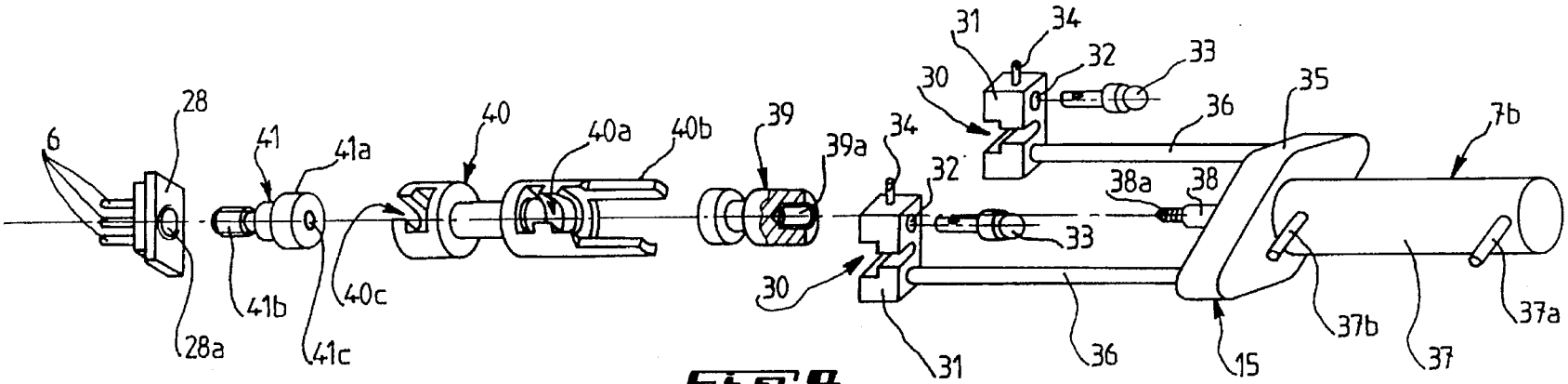
FIG. 4 is an exploded perspective view of the fastening of a reservation member actuating jack of the die casting machine shown on FIG. 1.

The internal shapes of the metal parts to be manufactured are obtained by means of hollow formation reservation members 6 and 6*a* such as pins or cores (see FIGS. 2 and 4).

The reservation members 6 are displaceable in a translatory motion through the agency of actuating mechanisms 7*b* such as hydraulic, pneumatic or electrical jacks.

The jacks 7*b* allow to insert and to extract the reservation members 6 into or from the inside of the die 2.

The die 2 is generally made from a metal such as cast iron or steel.

The die casting machine 1 comprises a framework 8 consisting of a frame 9 supporting upon its top face a plate 10 for receiving a bed plate 11 forming the base or bottom portion of the die 2 (see FIG. 2).

The side walls of the frame 9 may be recessed or hollowed out at least partially to improve the accessability to the framework 8.

The die casting machine 1 also comprises two cheek-moving jack carriers 12*a* and 12*b* mounted onto the frame 9 at the upper and opposite ends thereof.

The cheek-moving jack carriers 12*a* and 12*b* are mounted onto the framework 8 so as to be removable and adjustable by means of an indexing system consisting of position adjusting holes 13*a* and 13*b* formed in the side faces of the frame 9 and of the cheek-moving jack carriers 12*a* and 12*b*, respectively.

It is thus possible to adjust the cheek-moving jack carriers 12*a* and 12*b* in the height direction and in the longitudinal direction of the framework 8 by aligning a pair of holes 13*a* of the frame 9 with a pair of holes 13*b* of a jack carrier 12*a* or 12*b*, two lock or cotter pins (not shown on the drawings) being inserted into the said holes 13*a* and 13*b* for securing the assembly against motion on either side of the frame 9.

The cheek-moving jack carrier 12*a* exhibits an outward projecting cantilever or overhanging portion adapted to hold a cheek-moving jack 7*a* whereas the cheek-moving jack carrier 12*b* does not exhibit this cantilever or overhanging portion. It is of course possible to mount two identical cheek-moving jack carriers onto the framework 8 of the die casting machine 1.

The cheek-moving jacks 7*a* are adapted to displace the cheeks 3 through the medium of couplings 14 which are directly supported removably by the said cheeks 3.

In a manner like the couplings 14, carriers or holders 15 for the jacks actuating reservation members 6 are directly supported removably by the cheeks 3.

A gantry 16 forming an upper reservation member actuating jack carrier or holder is removably mounted onto the said plate 10 so that the jack 7*b* for the upper reservation member is overhanging the top face of the die 2.

On FIG. 2 it is seen that the gantry 16 comprises two cylindrical legs 17 which are extended downwards by a hooking end piece 18. The end piece 18 exhibits a throat with a reduced cross-section and a terminal portion with an enlarged cross-section.

The legs 17 are connected by a first cross-member 16*a* which supports a jack 7*b* for the actuation of an upper reservation member, a second cross-member 16*b* being mounted in sliding relationship onto the legs 17 and adapted to be displaced by the jack 7*b*.

The second cross-member 16*b* comprises on its bottom face 16*c* a runner or slider movable along a guide rail 16*d* and selectively lockable, the said runner or traveller 16*b* having a projecting rod adapted to be fastened to a hooking member 39.

The second cross-member 16*b* comprises at one of its ends a guide tube fitted onto one leg 17 and reinforcing gussets and at its other end a projecting U-shaped portion adapted to slide along the other leg 17.

The runner or traveller 16*c* permits to properly position the upper pins 6 vertically above an opening 27 formed in the die 2 in accordance with the position of the said opening of the top face of the die 2.

The end pieces 18 are adapted to engage through circular translatory motions slots 19 in the shape of an arc of a circle formed in projecting portions 10*a* of the plate 10.

The slots 19 are open at one of the ends of the arc of a circle to permit the insertion of the end pieces 18.

A U-shaped locking clamp 20 such as a yoke is caused to hold the gantry 16 against motion in position on the framework 8 by closing the open end of the slots 19.

The yokes 20 are fastened onto the plate 10 by means of stop pins or screws (not shown on the drawings) which extend through holes 20*a* and 19*a* formed through the yokes 20 and the plate 10, respectively.

The gantry 16 is used when the die 2 exhibits a reduced top face which is not sufficient for a possible installation of the jack carriers 15 onto the said top surface.

On FIG. 2 it is seen that the plate 10 is provided at its center with a rectangular hole 21 to allow the possible passage of a lower reservation member as well as the possible mounting of a jack carrier 15 underneath the bed plate.

The bed plate 11 is positioned onto the plate 10 plumb with the rectangular hole 21 by means of snugs or lugs 22 which are projecting below and from the bed plate 11 and which are adapted to engage holes 23 and an elongated groove 24 arranged on either side of the hole 21.

It is therefore possible to adjust the position of the bed plate 11 onto the plate 10 by causing one of the snugs 22 to slide within the groove 24 and by inserting the other snug 22 into one of the holes 23.

The bed plate 11 is held against motion in the direction of the height on the plate 10 by means of stops 25 displaceable in oblong guide grooves 26 formed in the top face of the plate 10.

The locking of the stop 25 within the oblong groove 26 is performed by means of the pivoted arm 25*b*.

A point or tip 25*a* projects from the stops 25 so as to engage an aperture 11*a* formed in the side wall of bed plate 11 so as to lock the said bed plate 11 in the direction of the height.

A core 6*a* projects from the top face of the bed plate 11 and is arranged in engaging relationship below the die 2 so as to reserve a hollow in the latter.

The reservation members 6 and 6*a* are caused to be accommodated within openings 27 formed through the walls of the die 2 and which open into the recesses 4 (see FIG. 5).

On FIGS. 1 and 2 it is seen that three pins 6 are supported from a supporting plate 28 which is caused to abut the external walls of the die 2.

On FIG. 5 it is seen that the die 2 comprises removable hooking studs or tenons 29 which are projecting from its external surface.

The tenons or studs 29 comprise two terminal cylindrical portions with an enlarged cross-section connecting by a cylindrical middle portion with a reduced cross-section. These tenons or studs 29 may however exhibit any shape whatsoever and in particular a dovetailed shape.

The die 2 shown on FIG. 5 also comprises tenons or studs 29 on its top face for the hooking of a reservation member jack holder in the case where the gantry 16 is not used.

It should be pointed out that the tenons 29 are arranged on a same side of the junction area of the cheeks 3 to avoid that the jack carriers 15 exert a spreading force upon the cheeks 3.

For the sake of clarity the upper tenons 29 have been shown on that cheek which is opposite to that which supports the pin holding plate 28.

The tenons 29 are adapted to be fitted into a mortise or slot of mating shape 30 formed in shoe-like end portions 31 of the jack holders 15. In this case the free terminal portion with an enlarged cross-section of the tenons 29 is jutting out of the mortises 30 whereas its portion with a reduced cross-section and its other terminal portion are fitted into the mortise 30.

The shoes 31 are moreover provided with thoroughfare holes 32 which are facing corresponding blind holes formed on the external surface of the die 2 when the jack carriers 15 are mounted onto the die 2.

The holes 32 and 32*a* are adapted to receive a safety pin 33 which is held against motion inside of the said holes through the medium of cotters 34.

The holes 32*a* may also serve the purpose of fastening tenons 29 onto the die 2.

The shoes 31 are connected to a cross-member 35 by legs 36 so as to form a U-shaped jack holder 15.

On FIG. 5 it is seen that the cross-member 35 comprises a central hole 35*a* for receiving a jack 7*b*.

The jacks 7*a* and 7*b* consist of a tube 37 and of a rod 38 adapted to slide within the tube 37.

The tubes 37 comprise each one two inlet and outlet hydraulic connectors 37*a* and 37*b*, respectively, for the operation of a corresponding jack.

The free end of the jack rod 38 is threaded so as to be caused to be screwed into a substantially cylindrical hooking member 39 with a shape similar to the tenon 29 exhibiting a middle portion with a reduced cross-section.

The hooking member 39 is adapted to be fitted into a recess of corresponding shape 40*a* of one of the ends of a strut module 40.

The end of the strut 40 corresponding to the recess 40*a* is longitudinally extended by two diametrically-spaced legs 40*b* adapted to abut against the cross-member 35 for limiting the useful stroke of the jack rod 38.

The legs 40*b* may be replaced by any abutment means such as a skirt-shaped cylinder portion.

The other end of the strut 40 comprises a recess 40*c* into which is fitting the head 41*a* with an enlarged cross-section of another hooking member 41 substantially in the shape of a door knob.

The strut 40 may comprises within its recesses 40*a* and 40*c* locking mechanisms with a notch and/or a spring for retaining the hooking members 39 and 41.

For example the hooking member 41 is formed with a blind hole 41*c* in its head 41*a* for receiving a ball of the aforesaid locking mechanism.

The strut 40 may of course rest upon the hooking members 39 and 41 under the sole effect of gravity.

The hooking member 41 is threaded at its other end 41*b* and is likely to be screwed into a tapped hole 28*a* formed in the plate 28.

Figure 3:
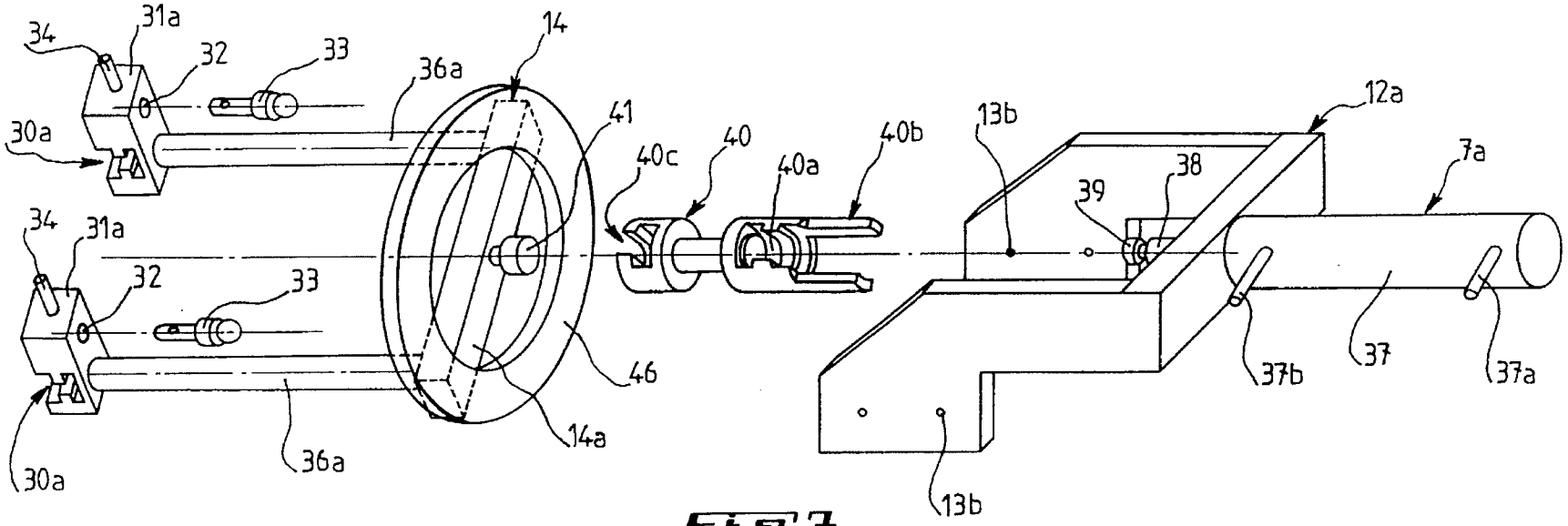
FIG. 3 is an exploded perspective view of the fastening of a cheek-moving jack of the die casting machine shown on FIG. 1.

On FIG. 3 it is seen that the cheek operating jack 7*a* is connected to the coupling 14 through the medium of a strut 40.

The strut 40 receives into its recess 40*c* the head 41*a* of the hooking member 41 which is likely to be screwed into a cross-member 14*a* of the coupling 14.

The coupling 14 comprises shoes 31*a* substantially similar to the shoes 31 and which are connected to the cross-member 14*a* by spaced legs 36*a* so as to form a shaped coupling.

Mortises 30*a* are formed in the shoes 31*a* and exhibit a shape corresponding to or mating with that of the tenons 29, namely two recesses with enlarged cross-sections connected by a recess with a reduced cross-section.

Unlike the shoes 31 of the jack holders 15, the tenons 29 may be fully fitted into the inside of the mortises 30*a* of the shoes 31*a*.

An at least partially circular bearing member 46 such as a ring is fastened onto each cross-member 14*a* and is adapted to bear and to slide upon supporting slat members 47 (see FIG. 2) mounted onto the frame 9.

These bearing members 46 permit to take up the load exerted by the weight of the couplings 14 upon the rod 38 of the cheek-operating jacks 7*a* and to avoid a possible tilting of the cheeks 3.

The bearing ring 46 shown on FIG. 3 exhibits a diameter at least greater than the length of the cross-member 14*a*.

Figure 6:
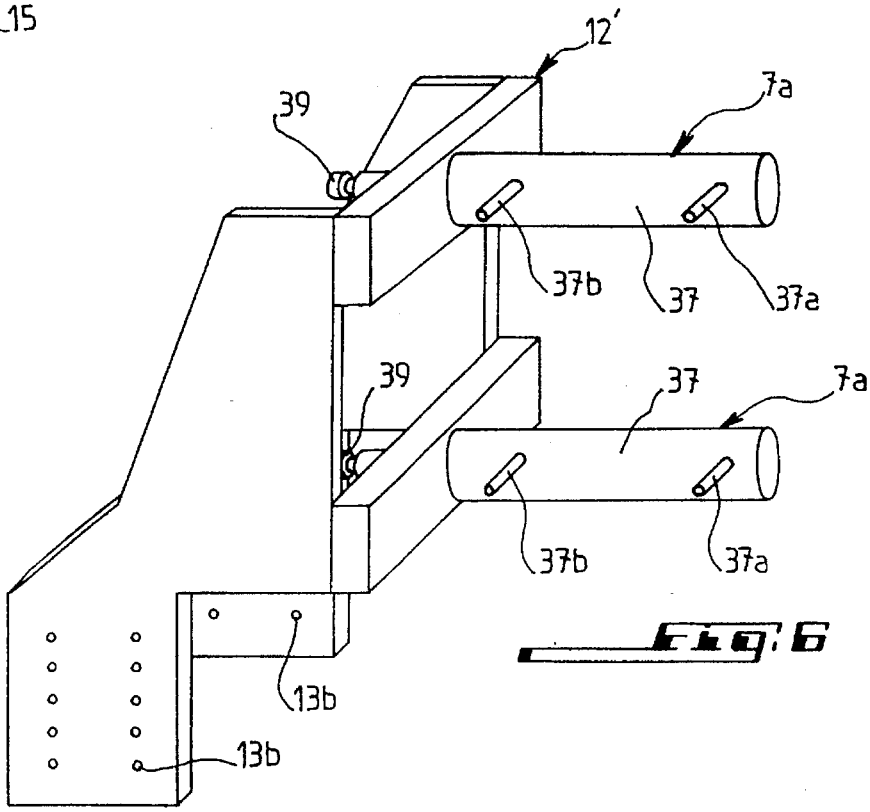
FIG. 6 is a perspective view of a cheek-moving jack carrier according to a third embodiment of the die casting machine of the invention.

FIG. 6 shows an alternative embodiment of the die casting machine according to the invention, wherein a cheek-operating jack holder 12' exhibits a twin-staged structure comprising two jacks 7*a* working in parallel relationship in the case for example of the use of a die with a great height.

Figure 7:
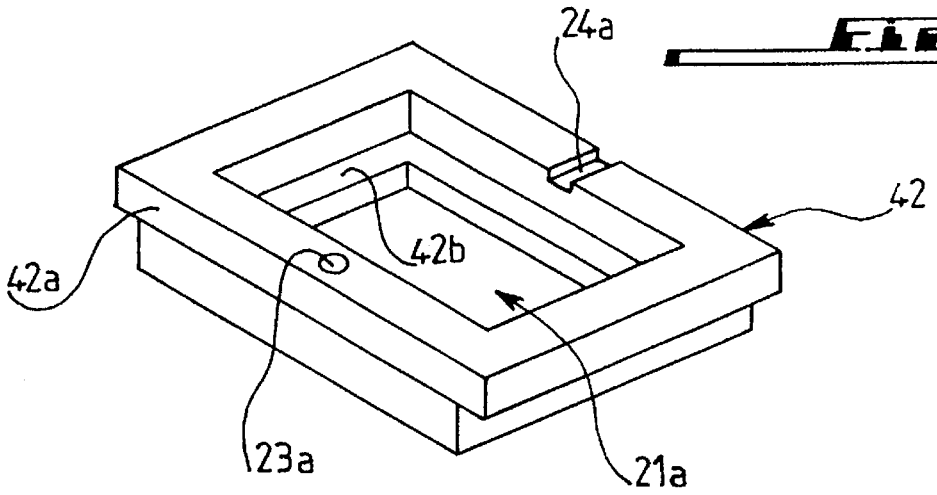
FIG. 7 is a diagrammatic view of a frame of a nest of frames of the die casting machine according to the invention.

On FIG. 7 has been shown an exemplary embodiment of a reducing frame 42 from a nest of frames, adapted to be fitted into the thoroughfare hole 21 so as to adjust the dimensions of the hole 21 without modifying the dimensions of the bed plate 11 the cost price of which is very high.

The frame 42 from a nest of frames, shown on FIG. 7 comprises an outer flange 42*a* and an inner flange 42*b* for bearing upon the plate 10 and receiving another frame 42 of smaller size, respectively, from a nest of frames.

The frame 42 from a nest of frames comprises in a manner similar to the plate 10 a blind hole 23*a* and an elongated groove 24*a* arranged on either side of a central hole 21*a* for receiving the snugs 22 of the bed plate 11.

The frames 42 from a nest of frames allow in particular to mount small bed plates corresponding to small dies onto the plate 10.

It is of course possible to design other shapes of frames for a nest of frames such as a frame for a nest of frames comprising flanges on two opposite edges only.

It appears clearly when reading the foregoing description that it is possible to mount the jack carriers 15 and the couplings 14 onto the cheeks 3 or to remove them therefrom very quickly without carrying out any screwing or bolting step.

A device for the operation and the control of the die casting machine according to the invention will now be described with reference to FIG. 8.

Figure 8:
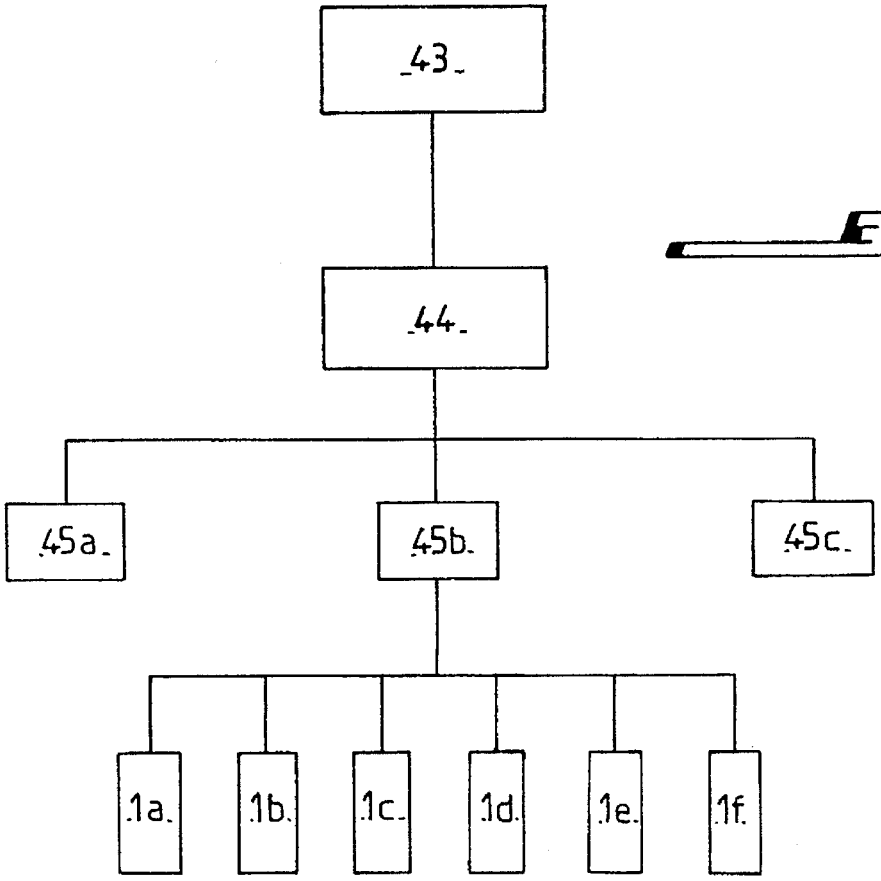
FIG. 8 is a functional block diagram of a device for the operation and control of the die casting machine according to the invention.

This device comprises a main processing unit 43, a computer for production management 44, several programmable automatons, for example three automatons 45*a*, 45*b*, 45*c* such as illustrated on FIG. 8, each automaton 45*b* being adapted to manage several die casting machines according to the invention, for example six die casting machines 1*a* to 1*f* in an independent and selective manner adapted to the needs of each die casting machine.

The main unit 43 comprises as stored in memories all the information data relating to the mold 2, to the metal parts to be produced and to the automatons 45*a*, 45*b*, 45*c*. The main unit 43 performs the essential function of managing the accountancy relating to the production and to dialogue with the production managing computer 44.

The production managing computer 44 comprises as stored in memories standard production programmes for the control of the automatons, and the said programmes may be parametered according to the different types of molds encountered in the small and medium-scale manufacture.

It is of course possible to provide instead of the computer 44 and of the unit 43 one single central processing unit.

Each automaton may be fitted, with a hydraulic distribution group allowing for example sixteen displacements, these displacements being distributed selectively and adapted to the specific needs of each die casting machine so as to allow each automaton to manage several die casting machines collectively and independently from each other.

Each automaton also comprises jack time-delay means adjustable in accordance with the evolution of the manufacture of the metal parts in particular in accordance with the solidification of the liquid metal.

The hydraulic distribution group of each automaton preferably comprises electromagnetic stroke-end sensors for each displacement generated by the hydraulic distributors.

Each automaton controls in real time the production of metal parts by means of sensors for measuring the temperatures within the molds, the temperature of the casting metal in furnaces or crucibles, the room temperature, the atmospheric pressure and the degree of ambient hygrometry permitting to collect or gather information data relating to the manufacture of the metal parts for the management of the quality control.

It is also possible to provide for the automaton automatically controlling the casting of molten metal into the dies and managing the cleaning of the casting skins and oxides formed on the casting ladles or spoons.

The automatons may comprise counters for the production cycles and for the number of scrap castings which taken in combination with the aforesaid sensors would facilitate the identification of the causes of the scrap castings.

It is moreover possible to provide emergency stop buttons as well as alarm knobs onto the automatons.

The device for the operation and the control of the die casting machines therefore allows to optimize the utilization of the group of functions of hydraulic distribution, time delay and stroke ends of each automaton and to independently transfer each die casting machine from one automaton to another one.

It should at last be pointed out that a movement controlled by a hydraulic distribution group may advantageously result in the simultaneous displacement of several jacks on a given die casting machine when the jacks, in particular the cheek-moving jacks may be coupled.

Although the present invention has been described in connection with several particular embodiments, obvious that it is not at all limited thereto and that it is possible to conceive many alternative embodiments and modifications without as much leaving its scope or departing from its gist.

What is claimed is:

1. A die casting machine for the production of metal parts, comprising:

at least two die cheek parts for receiving molten materials, wherein the die cheek parts form a cavity;

a framework having a supporting wall for supporting the die cheek parts;

at least one cheek-moving jack having means for supporting and displacing the die cheek parts, which permits removal of the metal parts;

at least one removable coupling member, wherein an end of the coupling member is removable and directly supported by a die cheek part and the other end is removably connected to the cheek-moving jack;

at least one cheek-moving jack carrier mounted on said framework;

at least one hollow-formation reservation member for insertion into the cavity;

at least one reservation member-moving jack having means for supporting and displacing the hollow-formation reservation member; and at least one removable reservation member-moving jack carrier, wherein an end of the latter is removably and directly supported by one of the die cheek parts.

2. A die casting machine according to claim 1, comprising at least one holding member, wherein the end of the coupling member removably fits onto the holding member which projects from the external surface of the die cheek part.

3. A die casting machine according to claim 1, comprising at least one holding member, wherein the end of the reservation member-moving jack carrier removably fits onto the holding member which projects from the external surface of the die cheek part.

4. A die casting machine according to claim 1, wherein each die cheek part and hollow-formation reservation member supporting and displacing means comprises a rod and further comprises a removable strut connecting the rod of the cheek-moving jack to the coupling member, and the rod of the reservation member-moving jack to the hollow-formation reservation member, respectively, each strut comprising a projecting portion for abutting against the cheek-moving jack carrier for limiting the useful stroke of each rod, each strut being interchangeable and belonging to a set of modules with predetermined lengths so as to adjust the said useful stroke of each rod.

5. A die casting machine according to claim 1, wherein each die cheek part and hollow-formation reservation member supporting and displacing means comprises a rod and further comprises a removable strut connecting the rod of the cheek-moving jack to the coupling member, and the rod of the reservation member-moving jack to the hollow-formation reservation member, respectively, each strut comprising a projecting portion for abutting against the reservation member-moving jack carrier for limiting the useful stroke of each rod, each strut being interchangeable and belonging to a set of modules with predetermined lengths so as to adjust the said useful stroke of each rod.

6. A die casting machine according to claim 1, wherein the cheek-moving jack carriers are mounted onto the framework of the die casting machine so as to be removable and adjustable by means of an indexing system, each cheek-moving jack carrier being interchangeable and pertaining to a set of modules with predetermined sizes.

7. A die casting machine according to claim 1, wherein the cheek-moving jack carriers comprise at least two stages of jacks working in parallel relationship.

8. A die casting machine according to claim 1, wherein each coupling member is superposed to at least one reservation member-moving jack carrier.

9. A die casting machine according to claim 1, comprising an upper reservation member-moving jack, wherein the jack consists of a gantry adapted to be removably mounted onto the framework.

10. A die casting machine according to claim 1, wherein a central processing unit controls and operates through actuation of the die casting machine by means of at least one programmable automaton, each automaton being adapted to manage a plurality of die casting machines and to independently and selectively actuate the presently available cheek-moving jacks and reservation member-moving jacks mounted onto each die casting machine.

11. A die casting machine according to claim 1, wherein the hollow-formation reservation members comprise pins or cores.

12. A die casting machine according to claim 1, comprising:

a removable bed plate which contacts the bottom of the die cheek parts to form part of the cavity, wherein said supporting wall supports said bed plate; and a reservation member-moving jack carrier which is removably and directly supported by the bed plate.

13. A die casting machine according to claim 12, wherein a hole is formed through the supporting wall of the framework at the place intended to receive the bed plate, the hole being adapted to receive frames of decreasing size which may be fitted into a nest of frames and which belong to the set of modules with predetermined sizes.

14. A die casting machine according to claim 12, wherein the supporting wall of the framework has an upper and a lower surface, wherein the upper surface is provided with an indexing device adapted to co-operate with a plurality of snugs which project underneath and from the bed plate for positioning the bed plate onto the supporting wall.

* * * * *